US006932342B2

(12) United States Patent
Hardie et al.

(10) Patent No.: US 6,932,342 B2
(45) Date of Patent: Aug. 23, 2005

(54) BOARD GAME

(75) Inventors: Jeannie Burns Hardie, Gardena, CA (US); James Harrison, Barnet Herts (GB)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/286,426

(22) Filed: Nov. 1, 2002

(65) Prior Publication Data

US 2003/0094758 A1 May 22, 2003

Related U.S. Application Data

(60) Provisional application No. 60/350,272, filed on Nov. 2, 2001.

(51) Int. Cl.[7] ..... A63F 3/00
(52) U.S. Cl. ..... 273/243; 273/248
(58) Field of Search ..... 273/243, 236, 273/248, 249, 251, 252, 253, 254, 244, 242

(56) References Cited

U.S. PATENT DOCUMENTS

| | | | | |
|---|---|---|---|---|
| 1,125,867 A | | 1/1915 | Mohr | |
| 3,572,718 A | | 3/1971 | Moore | |
| 3,883,142 A | | 5/1975 | Spohn | |
| 4,196,904 A | * | 4/1980 | Bailey | 273/256 |
| 4,480,838 A | | 11/1984 | Aharonian | |
| 4,629,195 A | | 12/1986 | Charney | |
| 4,949,975 A | | 8/1990 | Carrier | |
| 5,190,292 A | | 3/1993 | Perry | |
| 5,259,623 A | | 11/1993 | Kanelos, Sr. | |
| 5,265,879 A | | 11/1993 | Garcon et al. | |
| 5,478,086 A | | 12/1995 | Aylett | |
| 5,516,290 A | | 5/1996 | Quigley et al. | |
| 5,611,537 A | | 3/1997 | Burtt | |
| 5,662,327 A | | 9/1997 | Levinrad | |
| 5,743,529 A | | 4/1998 | Haynes | |
| 5,810,359 A | | 9/1998 | Wilkins et al. | |
| 6,019,371 A | | 2/2000 | Mantis | |
| 6,164,650 A | | 12/2000 | Wilkins et al. | |
| 6,565,090 B2 | * | 5/2003 | Aldridge | 273/254 |

* cited by examiner

*Primary Examiner*—Vishu K. mendiratta
(74) *Attorney, Agent, or Firm*—Kolisch Hartwell, P.C.

(57) ABSTRACT

The present invention provides a board game wherein players attempt to purchase a complete set of items from a number of repositories. The game further includes rules for the game including multiple levels of play, allowing older and younger children to play with the same apparatus. In a more advanced version of the game, the game board includes two sets of paths and rules for traveling along the paths.

9 Claims, 5 Drawing Sheets

BOARD GAME

CROSS-REFERENCE TO RELATED APPLICATIONS

This application is based upon and claims priority under 35 U.S.C. § 119(e) to the following U.S. provisional patent application, which is incorporated herein by reference in its entirety for all purposes: Ser. No. 60/350,272, entitled "Board Game," filed Nov. 2, 2001.

BACKGROUND AND SUMMARY OF THE INVENTION

The present invention relates to board games. More particularly, the present invention relates to rules and apparatus for playing a board game wherein the object of the game is to visit specified areas of the game board in order to purchase a set of items.

Examples of board games wherein players move around a board to visit different locations and make purchases include the Monopoly® board game (Hasbro, Inc.) and are disclosed in U.S. Pat. Nos. 1,125,867, 3,883,142, 3,572,718, 4,629,195, 5,190,292, 5,478,086, 5,516,290, 5,611,537, 5,662,327, 5,810,359 the disclosures of which are incorporated by reference in their entirety for all purposes.

Examples of board games utilizing more than one path include the Cranium® board game (Cranium, Inc.) and are discussed in U.S. Pat. Nos. 3,883,142, 3,572,718, 4,480,838, 4,629,195, 4,949,975, 5,259,623, 5,265,879, 5,662,327, 5,743,529, 5,810,359, 6,019,371, the disclosures of which are incorporated by reference in their entirety for all purposes.

The advantages of the present invention will be understood more readily after a consideration of the drawings and the Detailed Description.

DETAILED DESCRIPTION AND BEST MODE OF THE INVENTION

Figure 1:
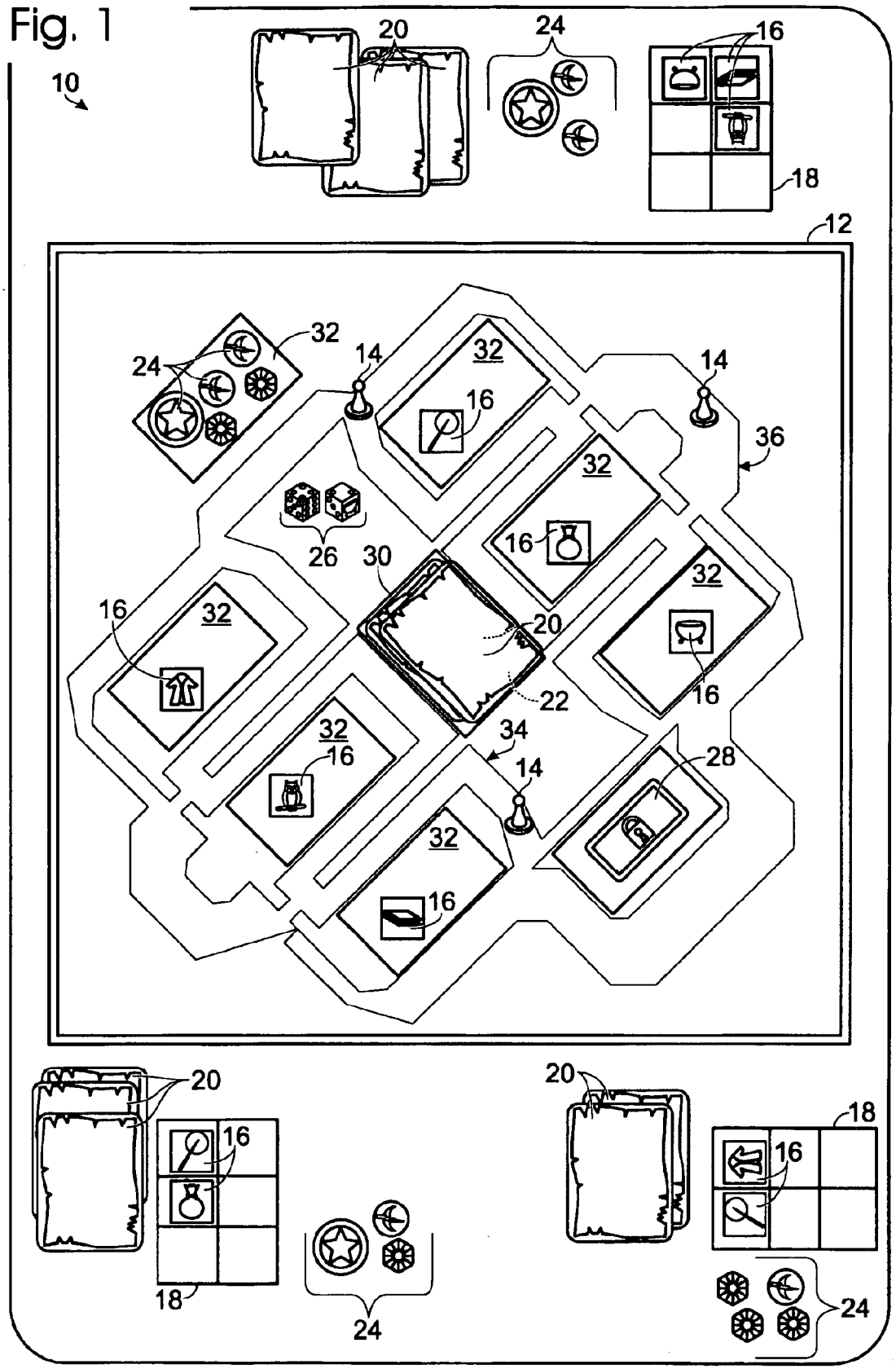
FIG. 1 depicts one embodiment of various game components suitable for use with the game of the present invention.

The elements of one embodiment of the present invention are shown in FIG. 1. Game 10 includes a game board 12, player pieces 14, items 16, shopping lists 18, a first set of cards 20, a second set of cards 22, monetary indicators 24, random number generators 26, a sign 28, and a draw pile 30 made up of card from sets 20 and 22. Typically, the game will be played by at least two players. The rules of the game require that players take turns moving a playing piece around a game board while trying to collect or purchase a predetermined set of items from different locations on the game board.

In some embodiments, game 10 may be based on a central theme and the shape and general appearance of the game board, player pieces, items, and other game elements may maintain this central theme. For example, in an embodiment in which the game is based upon the world created in the Harry Potter children's books by J. K. Rowling, the game and game elements may be based on a particular scene, event, or location described in the book. Accordingly, game board 12 may depict shops located in Diagon Alley, a shopping location described in the Harry Potter books, and items 16 may take the form of goods described in the book as being sold in the Diagon Alley shops. In keeping with the books' theme of wizards and witches, the player pieces may take the form of wizard's hats.

Figure 2:
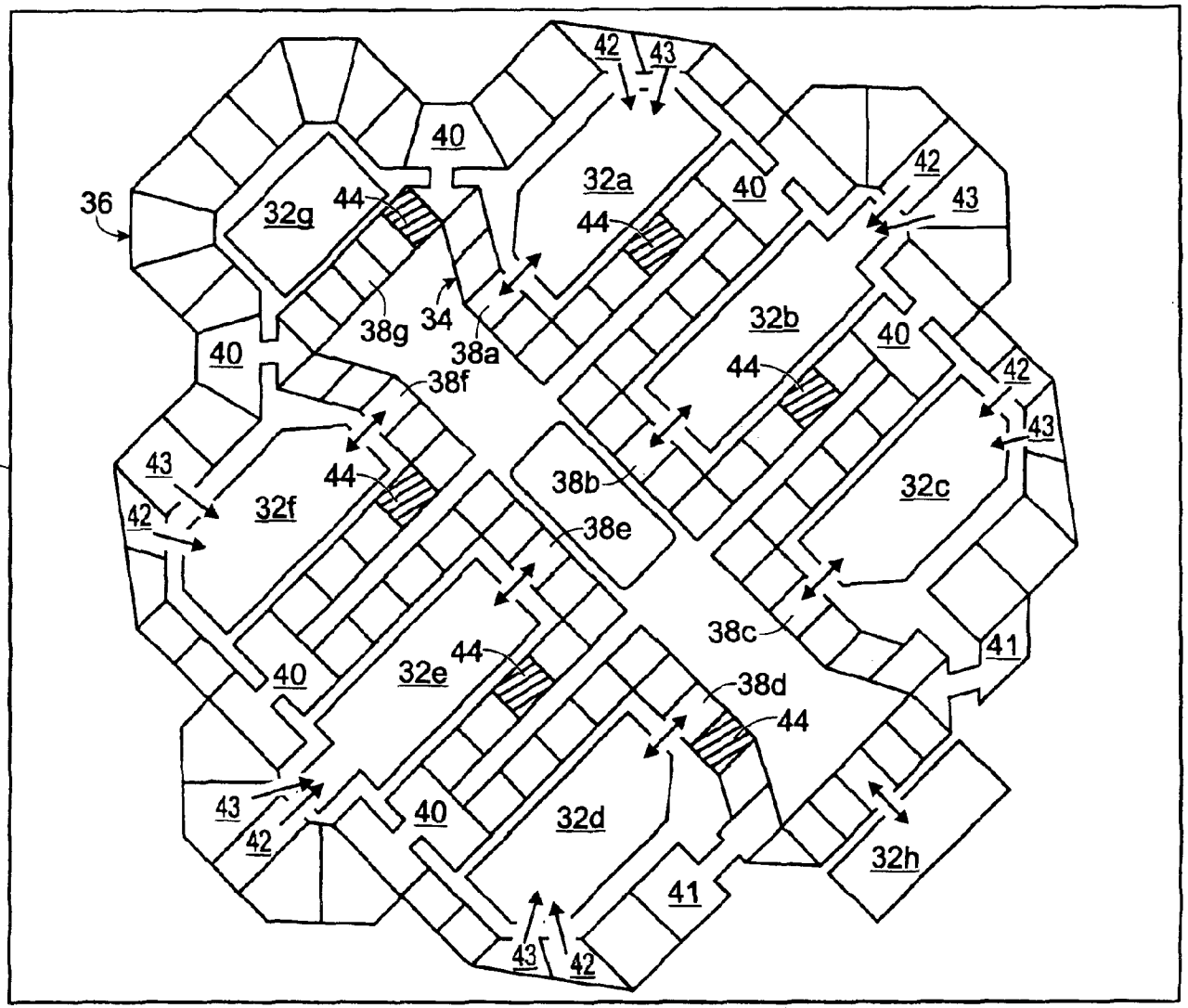
FIG. 2 depicts one embodiment of a game board suitable for use with the game of the present invention.

Typically, game board 12, shown in greater detail in FIG. 2, includes a number of repositories 32, from which the items may be obtained. It should be appreciated that not all of the repositories need be associated with items. For example, repositories 32*g* may take be a bank, while repository 32*h* may be a start/finish space. It will be appreciated that any number of repositories maybe used and that the repositories may be portrayed in any number of manifestations including as stores, houses, parks, cities, states, countries, planets, etc, as desired or appropriate for any particular theme being used.

As shown, game board 12 includes two paths, 34 and 36, which connect the repositories to each other. Path 34 is made up of a series of spaces that wend in a circular fashion around the central portion of game board 12. Path 36 begins and ends at repository 32*h* and extends around path 34. Path 34 is connected to each repository via a doorway space 38, while path 36 connects to the different repositories via backdoor spaces 42. Paths 34 and 36 are connected to each other via a series of gate spaces 40.

Path 34 may include marked spaces 44, which are differentiated from the other spaces by a specific color, pattern, or writing. Landing on a marked space 44 may allow or require a player to perform a particular action such as draw a card, roll again, or move a playing piece to a particular location.

Figure 3:
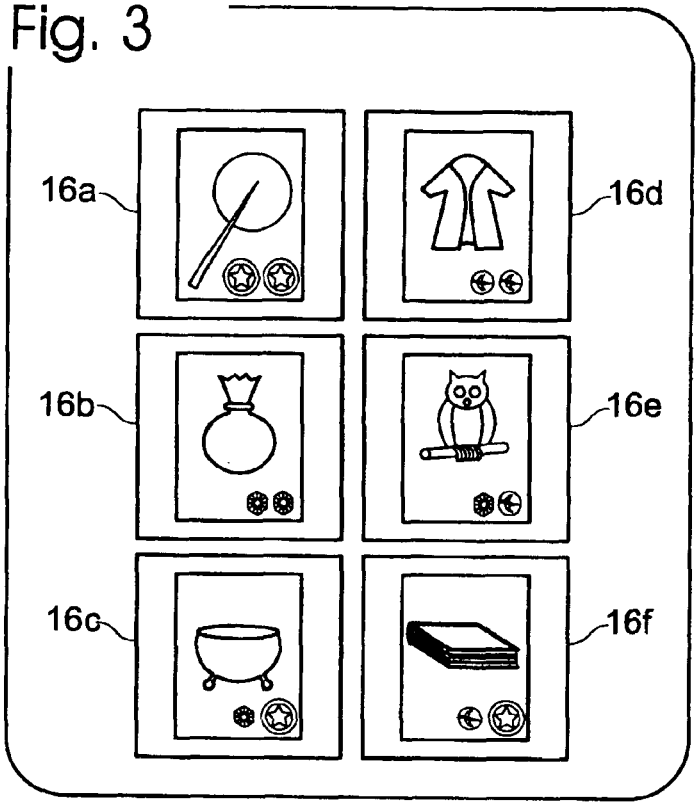
FIG. 3 depicts one embodiment of items suitable for use with the game of the present invention.

FIG. 3 shows an embodiment of items 16 suitable for use with the game of the present invention. As described above, players may obtain items 16*a*–16*f* from repositories 32*a*–32*f*. Thus, in an embodiment in which the repositories are depicted as stores, the items 16 may take the form of goods commonly available from those stores. For example, if repository 32*a* is a wand shop, then the items available from repository 32*a* could be wands, as shown at 16*a*. The items may be represented by pictorial representations on flat cardboard chits. As will be appreciated, the items may be represented by tokens, plastic figures, or in any other suitable manner.

Figure 4:
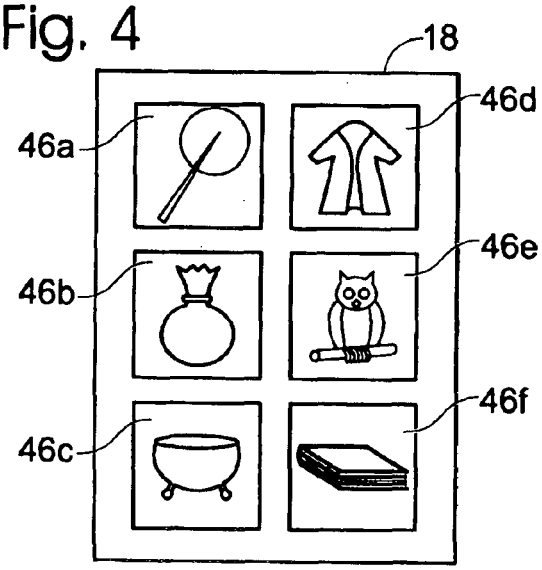
FIG. 4 depicts one embodiment of a shopping list suitable for use with the game of the present invention.

FIG. 4 depicts an embodiment of a shopping list 18 suitable for use with the present invention. The holder includes indicators 46*a*–46*f* to show the set of items 16 that need to be obtained by the player in order to win the game. For example, in the embodiment shown in FIG. 4, a player must collect 6 different items to win the game, as demonstrated by the use of six different indicators. As shown, each indicator includes a pictorial representation of an item to be collected. These pictorial representations may be sized and shaped to allow the player to place the appropriate item over the corresponding indicator.

Figure 5:
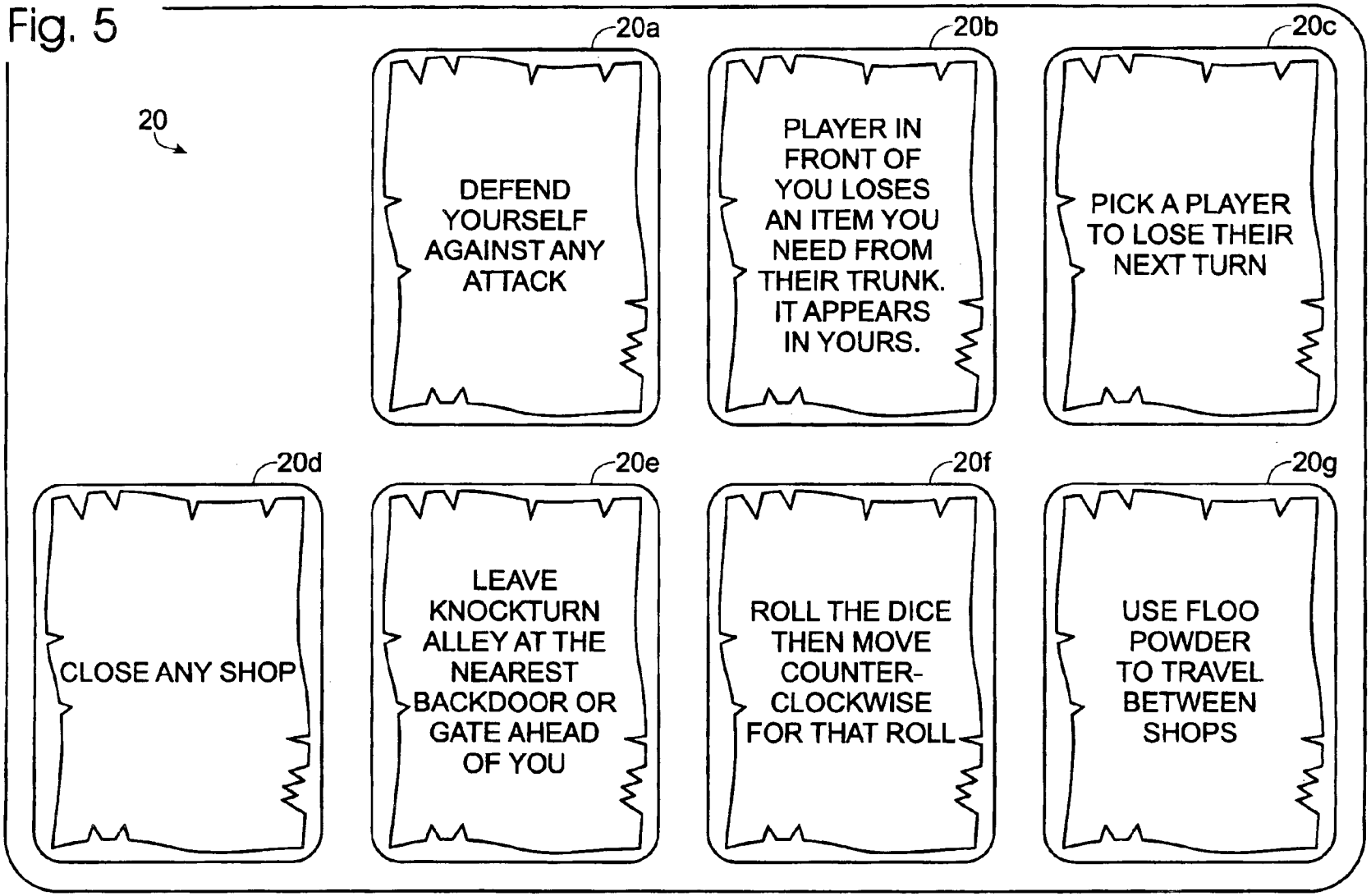
FIG. 5 depicts one embodiment of a first set of cards suitable for use with the game of the present invention.
Figure 6:
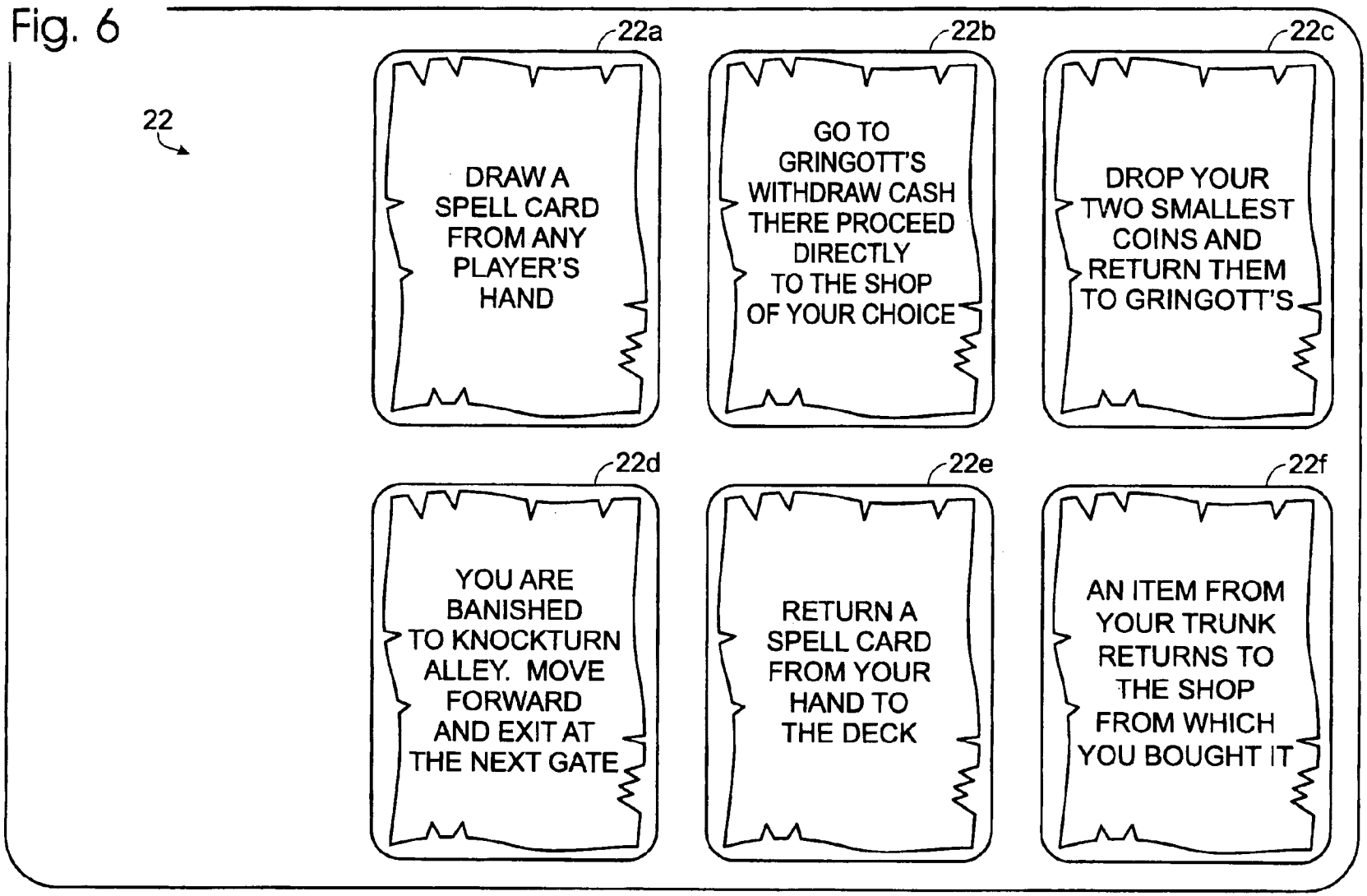
FIG. 6 depicts one embodiment of a second set of cards suitable for use with the game of the present invention.

As stated above, the game of the present invention may include two sets of cards 20 and 22. Examples of the types of cards that may be included in the first and second set of cards are shown in FIGS. 5 and 6. The first set of cards 20 contains a set of actions that may be performed by the player at a time of the player's choosing. The second set of cards 22 contains a set of actions that must be performed by the player when the card is drawn.

Figure 8:
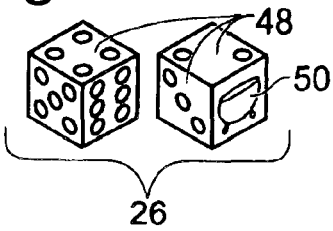
FIG. 8 depicts one embodiment of random number generators suitable for use with the game of the present invention.

FIG. 8 depicts examples of the types of monetary indicators 24 that are suitable for use with the present invention. In the presently shown embodiment, the monetary indicators 24 take the form of coins of various denominations. Alternatively, the monetary indicators 24 could take the form of simulated paper money, point indicators, chits, or the like.

Figure 9:
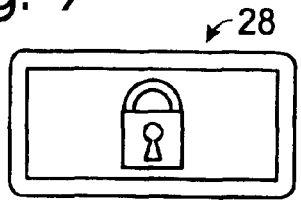
FIG. 9 depicts one embodiment of a sign suitable for use with the game of the present invention.

FIG. 9 depicts an example of random number generators 26 suitable for use with the present invention. As shown, the random number generator may take the form or two six-sided dice. In this particular embodiment, each die contains 5 numerical sides 48, which depict different numbers, for example the numbers 2 through 6. In the embodiment shown, each of these numbers is represented by a set of dots. The remaining iconic side 50 depicts an icon or symbol. In the embodiment shown, the iconic sides 50 of both dice show the same icon, a cauldron. Alternatively, any suitable icon could be used. For example, it may be desirable to use an icon of particular significance to the theme on which the game is based. In addition, each of the dice could depict a different icon, for example, to provide additional game play options.

In some methods of play, one or more of the repositories may be closed for business during certain periods of the game. In this case, it may be desirable to indicate the store's open or closed status with the use of a sign. Such a sign 28 is shown in FIG. 9.

In one method of play, the players move their playing pieces around game board 12 visiting shops offering items for sale and competing to be the first to purchase all the items on their shopping list (i.e. those items depicted on the shopping list 18). Initially, each player begins with a predetermined amount of money. Each player moves their player piece around the board by rolling dice 26 and moving the player piece the number of spaces indicated. If dice 26 include an iconic side 50, as shown in FIG. 9 and described above, rolling one or more of the iconic sides may have special meaning for the game. For example, rolling one iconic side may allow the player to roll again. Rolling both iconic sides may allow a player to move to a specific area of the game board, such as the bank, and collect money.

A player may enter a repository by landing on or passing over a doorway space 38. Once inside the repository, the player may purchase the item available from that repository. In some methods of game play, the player must use exact change to purchase the item. The players may keep track of purchased items by placing the chits representing the items on the appropriate spots on their shopping lists.

As stated above, not all of the repositories may offer items for sale. In one embodiment one of the repositories may take the form of a bank. Typically, players collect a predetermined amount of money when they pass the doorway space associated with the bank, thus enabling players to purchase additional items on their shopping lists.

In some embodiments, in addition to rolling the dice to enter a repository from path 12, players also may move their playing pieces directly from one repository to another, including the bank and the start/finish space, by performing a specific action. For example, after having entered a shop by landing on or passing over a doorway space, a player may travel directly to a repository of her choice by correctly guessing whether a single dice roll will result in a low roll (icon, 1, 2, or 3) or a high roll (4, 5, or 6). If the player guessed correctly, she may move her playing piece to the repository of her choice. If the player guessed incorrectly, she cannot move her playing piece from the present repository.

The game of the present invention provides for multiple levels of game play ranging in difficulty level. An alternate and more advanced method of play includes the use of second path 36, and cards 20 and 22. As in the above-described embodiment, players travel around the game board attempting to purchase a complete set of items 16. However, in this embodiment, the number of some or all of the items may be limited, such that the number of a specific item available may be less than the total number of players playing the game. For example, if four players are playing the game, only three items may be available from each repository. This forces the players to compete for the various items and adds complexity to the game play, which may be more desirable for older or more advanced players.

Figure 7:
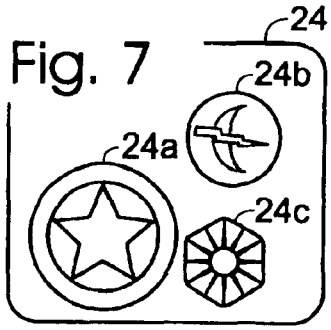
FIG. 7 depicts one embodiment of monetary indicators suitable for use with the game of the present invention.

As stated above, this embodiment employs the use of cards 20 and 22. Cards 20 describe actions that may be performed by a player holding the card at any time during the game. Thus, players typically collect cards 20 during the game and play them as needed. In contrast, cards 22 describe actions that must be performed by the player at the time the card is drawn. Each player may be dealt a predetermined number of cards 20 before game play begins. Typically the remaining cards 20 and 22 are shuffled together and placed on the game board face down in a draw pile 30. Examples of cards 20 and 22 are shown in FIGS. 6 and 7 and/or described below.

As with the above embodiment, players use a random number generator, such as the pair of six-sided dice 26 described above, to determine the number of spaces to move their playing pieces along paths 34 or 36. However, the consequences of the numbers and/or icons rolled may differ from the previously described embodiment. For example, in this embodiment, rolling an icon may allow a player to draw a card from draw pile 30.

Players may enter path 36 through a number of methods. For example, the rules may specify that a player who rolls double icons must move their playing piece to path 36. Alternatively, a player may choose to enter path 36 through a gate space 40 or play a card that banishes another player's playing piece to path 36. Typically, once a player's playing piece is on path 36, the actions that player can take are limited. For example, the player may not be allowed to collect money, draw a card, or play specific cards. The rules of the game may describe any number of methods for escaping path 36. For example, the player may be allowed to leave path 36 if he rolls doubles, lands by exact count on a gate space 40, lands by exact count on a backdoor space 42, or plays a card that gives the player the power to leave path 36.

The game may include a card that enables a player to move directly from one repository to another. According to the rules for more advanced game play, a player using this card may have to show the card and declare whether he thinks he will roll odd (icon, 1, 3 or 5) or even (2, 4 or 6) before rolling a die. A correct guess allows the player to move to any desired repository. However, an incorrect guess requires the player to move his playing piece to a randomly determined or undesirable location.

Alternatively or additionally, one or more of the cards may allow a player to close any of the repositories 32, including the bank and the start/finish spot. Typically, if a repository is closed players may still obtain items from the repository, but must first get inside. This may be accomplished by entering through a back door space 42, playing an appropriate card, or by traveling directly from one repository to another using the method described above.

As stated above, in this method of game play there may be fewer items 16 of a given type than the number of players playing. Thus, some items 16 may sell out before a player can purchase them. Items 16 may be made available by any number of suitable methods. For example, the game may include a card that requires the owner of the card to return an item to the appropriate shop. The item is then available for purchase. As another example, the game may include a card that allows the owner of the card to require another player to give an item to the card's owner.

In one embodiment, the game may be based on a well-known popular culture phenomenon, such as a book or movie. Accordingly, the example below is based on the popular children's book *Harry Potter and the Sorcerer's Stone*, by J. K. Rowlings, and players of the game take on the rolls of witchcraft and wizardry students attempting to purchase items needed to return to school.

An example of a set of rules for a game constructed in accordance with an embodiment of the present invention follows:

EXAMPLE I

Diagon Alley Board Game

Game Contents

1 Game board 12
1 Closed Sign 28
2 Dice 26
6 Moving Hats 14
6 Trunk Cards 18
36 Trunk Items 16
6 Potion Bottles 16*b*
6 Owls 16*e*
6 Books 16*f*
6 Cauldrons 16*c*
6 Robes 16*d*
6 Wands 16*a*
60 Coins 24
20 "Gold" Galleon Coins 24*a*
20 "Silver" Sickle Coins 24*b*
20 "Bronze" Knut Coins 24*c*
46 Diagon Alley Cards:
30 Spell Cards (Parchment) 20
16 Havoc Cards (Purple) 22

Object

Visit all the Shops 32 on the board 12 and purchase one of the Trunk Items 16 they sell. The first player to completely fill their Trunk Card 18 and make it back to the Leaky Cauldron 32*h* wins.

The Board of Diagon Alley

If you are going to be the first to fill your trunk, it helps to know where to go.

DIAGON ALLEY PATHWAY 34—Follow this path to visit the shops of Diagon Alley.

KNOCKTURN ALLEY PATHWAY 36—Follow this path if you are banished from the Diagon Alley pathway 34.

SHOPS 32—Visit the Shops to purchase your school supplies (items 16). The Items they sell appear on the sign in front of each Shop.

THE LEAKY CAULDRON 32*h*—Begin your adventure here, then end it here as well when your trunk is full.

GRINGOTTS WIZARDS BANK 32*g*—Collect your wizard money 24 each time you pass by.

CARD SPACE 44—Draw a Diagon Alley Card 20, 22 whenever you land on a stone with the magic swirl.

DOORWAY SPACE 38—If you land on or pass over the space directly in front of a Shop's front door you can enter that Shop.

GATE SPACE 40—these are any spaces in front of or behind a gate. You land here when banished to or escaping from Knockturn Alley 36. The spaces are Purple on the Knockturn Alley side, brown on the Diagon Alley side.

BACKDOOR SPACE 42—One purple space behind each Shop allows you to move into that Shop from Knockturn Alley.

FLOO SPOT (43)—Count or land on these spaces labeled with green curls of smoke when using a Floo Powder Spell card 20*g*.

DRAW PILE 30—Place the deck of Diagon Alley cards here.

Game Set-up

Open the game board 12 in the center of the playing area.

Select a Hat Mover 14 and a Trunk Card 18. Place your Mover in the Leaky Cauldron 32*h* (the pink Shop at the end of Diagon Alley) and the Trunk Card face-up in front of you.

The oldest player acts as the Gringotts Bank Goblin and the dealer.

Give each player 2 Gold Galleons 24*a*, 2 Silver Sickles 24*b*, and 2 Bronze Knuts 24*c*. Stack the rest of the money inside the Gringotts space 32*g*.

Divide the Diagon Alley Card deck into two piles: the parchment-colored Spell cards 20 in one pile and the purple Havoc cards 22 in the other pile.

Shuffle the Spell cards 20 and deal two cards to each player. You may look at your cards, but don't allow the other players to see them.

Shuffle the remaining Spell cards 20 with the Havoc cards 22 and place the entire deck face down on the DRAW PILE space 30 in the center of the game board.

Sort the Trunk Items 16 into separate piles. You will have 6 piles of 6 Items each.

Match the Trunk Items 16 to the Shops 32 by their colors and the signs in front of each Shop.

Place one Wand Trunk Item 16*a* on Ollivanders Wand Shop 32*a* for each player playing.

For the remaining 5 Trunk Items, place one less Item on its matching Shop than the number of players playing.

For Example

If four people are playing, place four wands on Ollivander's. But, place only three of each of the other Trunk Items on their matching Shops.

Set all unused Trunk Items 16, Trunk Cards 18, and Hat Movers 14 aside.

Let's Play

Each player rolls one die 26. Highest roil goes first. Play proceeds, in turn, to the left. The symbol side 50 of the dice is always low.

On your turn, roll both dice 26 and move your Hat 14 clockwise as the dice indicate. (See THE DICE below)

If you land on a space with a magical swirl 44 or roll a cauldron symbol 50 on one dice, draw a card from the draw pile and play accordingly. (see THE CARDS below)

If you land on or pass a Doorway Space 30 in front of a Shop 32, you may enter the Shop. (See GETTING AROUND below)

Once in a shop 32, you may buy a Trunk Item 16 if one is available and you have the exact wizard money listed. (See PURCHASING A TRUNK ITEM below.)

Gringotts Bank 32*g* does not sell any Trunk Items, but every time you land on or pass its Doorway Space 38*g* the Gringotts' Goblin gives you 1 Gold Galleon 24*a*, 1 Silver Sickle 24*b*, and 1 Bronze Knut 24*c*. You cannot enter Gringotts.

If you roll double cauldron symbols 50 or draw a "Banished to Knockturn Alley" Havoc card 22*d*, you must move to the next available Gate Space 40 and enter Knockturn Alley 36. (See KNOCKTURN ALLEY below)

Every Shop 32 in Diagon Alley (except Gringotis) contains a Floo Spot (43) indicated by green smoke rising from its chimney. If you have a Floo Powder card 20*g* in your hand, you can leap directly from Shop to Shop if you use the card successfully. (See USING FLOO POWDER below)

The first player to fill their Trunk Card 18 with one of each of the Trunk Items 16 and return to the Leaky Cauldron 32*h* wins the game.

The Dice

The Diagon Alley dice 26 do not have a number "1" side, but a cauldron symbol 50 instead. If you roll:

Numbers on both dice: Move clockwise the number of spaces indicated.

One cauldron symbol and one number: Move the number of spaces on the numbered die and, then, draw a Diagon Alley card.

Note: A Cauldron symbol does not count as a "1". It has no numeric value.

Double cauldron symbols: You are immediately banished to Knockturn Alley 36. Move your Hat 14 to the nearest Gate Space 40 ahead of you and enter Knockturn Alley. Do not draw a card.

Note: Rolling any doubles (the same number or symbol on both die) allows you to escape from Knockturn Alley. (See EXITING KNOCKTURN ALLEY below).

Getting Around

Always move in a clockwise direction around Diagon Alley 34 and Knockturn Alley 36 unless otherwise directed.

Two Hat Movers may not occupy the same space in Diagon Alley or Knockturn Alley. If you land on a space already occupied by another player, move your Hat forward to the next available space.

Landing or passing over a Doorway Space 38 allows you to enter that Shop 32. You do not have to enter if you do not need to. To enter, place your Hat Mover 14 on the roof of the Shop (i.e. inside space 32).

If you roll more than you need to reach a Doorway Space, you give up any extra spaces you could have moved once you enter the Shop.

More than one player may be inside a Shop at any time.

Whenever you leave a Shop 32, the Doorway Space 38 counts as your first move.

Purchasing a Trunk Item

You must first enter a Shop 32 before you can a purchase a Trunk Item 16.

Every Trunk Item has a specific cost, indicated by the wizard money symbols on the Trunk Item itself. You must have the exact coins listed to purchase the Item.

For Example

If the symbols on a Trunk Item indicate you need 1 "Bronze" Knut 24*c* and 1 "Silver" Sickle 24*b* to purchase, you VGUI cannot use two Galleons 24*a* to buy the Trunk Item.

Note: Exchanging wizard money for lesser coins is not allowed.

If you don't have the right coins to make your purchase, you must wait until you have collected more coins by passing Gringotts.

When you make your purchase, return the spent coins to Gringotts 32*g* and place the Trunk Item 16 on your Trunk Card 18.

If the Shop is sold out of its Item, you must wait until the Item becomes available again (See RETURNING TRUNK ITEMS below) or use a Spell card 20 to take the Item from another player (see THE CARDS below).

You may not purchase duplicate Trunk Items to prevent other players from getting them.

Knockturn Alley

A wall surrounds Diagon Alley 34 protecting it from Knockturn Alley 36. The only way in or out of Knockturn Alley is through the wall gates 40 or the Shop's Backdoors 42.

Entering Knockturn Alley

If you roll double cauldron symbols 50, you must travel forward to the next Gate Space 40. Place your Hat 14 on the Knockturn Alley side of the Gate.

If you are "Banished to Knockturn Alley" by a card, enter Knockturn Alley as above. Your turn is now over.

In some instances, a player may choose to enter Knockturn Alley 36 (such as when they are trying to enter a Closed Shop through its Backdoor 42—see THE CARDS below). If you land, on or pass over a Gate Space 40 you may enter Knockturn Alley just as you would enter a Shop. Place your Mover on the Knockturn Alley side of the Gate and your turn ends. If you rolled more than you needed to reach the Gate Space, you give up any additional moves you could have made once you enter Knockturn Alley.

Note: You may never enter Knockturn Alley through a Shop's Backdoor.

Moving Around Knockturn Alley

Move your Hat in a clockwise direction.

If you pass a Shop's Backdoor, you may not enter or purchase any Items.

If you pass Gringotts, you may not collect any wizard money.

If you roll a cauldron symbol, you may not draw any cards.

You cannot play any cards in your hand except the "Exit Knockturn Alley" Spell card.

Exiting Knockturn Alley

If you roll doubles, even double cauldron symbols, move forward to the next Backdoor Space 42 or Gate Space 40. Place your Hat 16 on the Diagon Alley or Shop side of the Space. Your turn is now over.

Note: If you exit into a Shop 32 through its Backdoor 42, you may purchase that Shop's Trunk Item 16, if available.

If you land by exact count on a Backdoor Space 42 or a Gate Space 40, place your Hat on the Diagon Alley or Shop side of the Space.

If you have an "Exit Knockturn Alley" Spell card 20*e* in your hand, play the card, move forward and exit as described above.

Note: This is the only card you are allowed to play while in Knockturn Alley.

If you travel all the way around Knockturn Alley you will reach an Exit Gate 41. When you reach this Gate Space—by exact count or not—place your Hat on the Diagon Alley side of the space. Your turn is over.

The Cards

The Diagon Alley Cards come in two varieties—Spell cards 20 and Havoc cards 24.

If you draw a Spell card, keep it in your hand and play it whenever you want.

If you draw a Havoc card, follow its directions immediately.

At any time during your turn (even before you roll the dice), you may play a Spell card by following the directions on the card. You may play as many Spell cards as you like.

You may not play a card during another player's turn unless you are defending yourself from a card played against you.

Once you have played either type of card, return it to the bottom of the Draw Pile 30 in the center of the board.

Specific Cards

Close a Shop Spell Card 20*d*

The Close a Shop card allows you to close any Shop on the board, including Gringotts or the Leaky Cauldron.

When you play the Close a Shop card, place the Closed Sign 28, FIG. 9, on that Shop.

Players may not enter a Closed Shop from the front (i.e. from Diacion Alley 34).

Players may purchase Items 16 from a Closed Shop, but must first get inside. The two ways to enter a Closed Shop are:

Enter from Knockturn Alley 36 through a Shop's Backdoor 42.

Enter by using a Floo Powder Spell card 20*g*.

Note: You may exit the front Doorway 38 of a Closed Shop as if it were open.

Playing another Close a Shop card 20*d* allows you to move the Closed Sign 28 to a new Shop, opening up the first Shop.

Note: Closing a Shop is an effective way to block your opponents from getting Trunk Items 16 or the money 24 they need. It can also prevent other players from entering the Leaky Cauldron 32*h* and winning the game.

Note: Closing a Shop is an effective way to block your opponents from getting Trunk Items or the money they need. It can also prevent other players from entering the Leaky Cauldron and winning the game.

Floo Powder Spell Card 20*g*

If you have a Floo Powder Spell card in your hand, you may use it to travel to any Shop with green smoke curling from its chimney. Gringotts is the only place you cannot reach in this manner.

Before you can use the Floo Powder card, you must be inside a Shop.

Turn the Floo Powder card face-up in front of you.

Take one die and declare whether you think you will roll odd (cauldron symbol, 3, or 5) or even (2, 4, or 6).

Roll the die.

If you declared correctly, you may travel to any Shop you choose except Gringotts. Place your Mover on the Shop's roof.

Note: If you pass Gringotts on your way, do not collect any wizard money.

If you declared incorrectly, move clockwise the number of Floo Spots that you rolled and place your Mover on that Shop's roof. Do not count the Floo Spot of the Shop you are in as your first move. Do not count Gringotts as a space or collect any wizard money.

Floo Powder allows you to enter a Closed Shop, including the Leaky Cauldron.

Once you have used Floo Powder your turn is over, although you may first purchase Items from a Shop that you enter with Floo Powder.

Returning Trunk Items

Because there are fewer Trunk Items in most of the Shops than players playing, some Trunk Items may sell out before you get to them. There are two ways a sold out Item becomes available again.

If you draw a "An item from your trunk returns to the Shop from which you bought it" Havoc card 22*f*, you must return one of the Items in your trunk to its Shop. Any other player may then purchase that Item by visiting the Shop.

If you have a "Player in front of you loses an Item you need from their trunk. It appears in yours" Spell card 20*b*, you may play it on the player directly ahead of you (on Diagon Alley or in a Shop). Choose an Item from their trunk and add it to your Trunk Card or return it to its Shop.

Note: This card cannot affect players in Knockturn Alley.

Winning The Game

Once you've filled your trunk 18 with one of each of the Trunk Items 16, race to the Leaky Cauldron 32*h* by any means. The first player to enter the Leaky Cauldron with a full Trunk Card wins the game.

Optional Rules for Younger Players

Diagon Alley can be simplified to allow younger children to enjoy the game. Follow the same rules described above, making the following changes:

Game Set-up

Remove the Spell and Havoc cards and the Closed Sign from play.

Place one Trunk Item in each Shop for each player.

Game Play

Youngest player moves first.

Players move around the board as described above, except for the following:

Card Spaces 44 are "Roll Again" Spaces. If you land on a Roll Again Space, roll again and move.

If you roll 1 cauldron symbol 50 on either die, move the number indicated and roll again. The cauldron symbols do not count as "1".

Note: There is no limit to the number of times you can roll again. But, if you roll a cauldron symbol 50 and land on a Roll Again Space 44 on the same turn, you may only roll again once for that turn.

If you roll double cauldron symbols 50, the player may move to the Gringotts Doorway Space 38*g*. Collect your wizard money 24 and roll again.

Note: If the player does not wish to move to Gringotts, they do not have to.

Players can use Floo Powder anytime during the game to travel from Shop to Shop. To move by Floo Powder:

Enter any Shop.

Guess whether you will roll low or "1, 2, 3" OR high or "4, 5, 6" and tell the other players. Cauldron symbols count as "1".

Roll one die.

If guessed correctly, move to the Shop of your choice.

Note: Do not collect any money if you pass by Gringotts.

If guessed incorrectly, stay where you are. You must enter another Shop before you can try Floo Powder again.

You may only try to use Floo Powder once a turn.

Note: After using Floo Powder, your turn is over, even if you rolled a cauldron symbol on your turn.

Collect wizard money 24 and purchase Trunk Items 16 in the same manner as in the full game.

Winning the Game

The first player to purchase all the Trunk Items 16 to fill their Trunk Card 18 and make it back to the Leaky Cauldron 32*h* wins the game!

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such neither requiring nor excluding two or more such elements.

Inventions embodied in various combinations and subcombinations of features, functions, elements, and/or properties may be claimed in a related application. Such claims, whether they are directed to a different invention or directed to the same invention, whether different, broader, narrower or equal in scope to any original claims, are also regarded as included within the subject matter of the inventions of the present disclosure.

What is claimed is:

1. A method of playing a board game comprising:

moving playing pieces on a playing surface having:

a plurality of repositories offering accumulable items;

a first path providing at least one access point to each of the repositories;

a second path providing at least one alternative access point to each of the repositories;

wherein a player traveling the first path may engage in actions that are unavailable to the player when traveling the second path; and accumulating a complete set of items from the repositories by:

collecting money; and purchasing an item from each of the repositories offering accumulable items;

wherein at least one of the actions that are unavailable is collecting simulated money.

2. A method of playing a board game comprising:

moving playing pieces on a playing surface having:

a plurality of repositories offering accumulable items;

a first path providing at least one access point to each of the repositories;

a second path providing at least one alternative access point to each of the repositories;

wherein a player traveling the first path may engage in actions that are unavailable to the player when traveling the second path; and accumulating a complete set of items from the repositories by:

collecting money; and purchasing an item from each of the repositories offering accumulable items;

wherein at least one of the actions that are unavailable is drawing a card.

3. A method of playing a board game comprising:

moving playing pieces on a playing surface having:

a plurality of repositories offering accumulable items;

a first path providing at least one access point to each of the repositories;

a second path providing at least one alternative access point to each of the repositories;

wherein a player traveling the first path may engage in actions that are unavailable to the player when traveling the second path; and accumulating a complete set of items from the repositories by:

collecting money; and purchasing an item from each of the repositories offering accumulable items;

wherein the step of moving playing pieces on the playing surface is accomplished by rolling a pair of six-sided dice, wherein each die has five sides that display numbers and one side that displays an icon.

4. The method of claim 3 wherein rolling an icon allows the player to engage in a predetermined action.

5. The method of claim 4 wherein the predetermined action is picking a card.

6. The method of claim 4 wherein the predetermined action is moving to a particular area on the playing surface.

7. The method of claim 3 wherein a player may move directly to a desired repository by predicting the outcome of a dice roll.

8. A method of playing a board game comprising:

moving playing pieces on a playing surface having:

a plurality of repositories offering accumulable items;

a first path providing at least one access point to each of the repositories;

a second path providing at least one alternative access point to each of the repositories;

wherein a player traveling the first path may engage in actions that are unavailable to the player when traveling the second path; and accumulating a complete set of items from the repositories by:

collecting money; and purchasing an item from each of the repositories offering accumulable items;

wherein one of the repositories may be closed for a period of time during the game.

9. The method of claim 8 wherein when a repository is closed, players traveling the first path may not enter the repository, but players traveling the second path may enter the repository.

* * * * *